United States Patent [19]

Stock et al.

[11] 4,061,010

[45] Dec. 6, 1977

[54] APPARATUS FOR COOLING THE ROLLS OF ROLLING MILLS

[75] Inventors: Thomas Adrian Cheetham Stock; Patrick Daniel Dougan; Olivo Guiseppe Sivilotti, all of Kingston, Canada

[73] Assignee: Alcan Research and Development Limited, Montreal, Canada

[21] Appl. No.: 723,966

[22] Filed: Sept. 16, 1976

Related U.S. Application Data

[62] Division of Ser. No. 585,460, June 10, 1975, Pat. No. 3,994,151.

[30] Foreign Application Priority Data

June 11, 1974 United Kingdom ..... 25942/74

[51] Int. Cl.[2] ..... B21B 27/10

[52] U.S. Cl. ..... 72/201; 72/236

[58] Field of Search ..... 72/200, 201, 202, 236, 72/364

[56] References Cited

U.S. PATENT DOCUMENTS

| | | | |
|---|---|---|---|
| 737,571 | 9/1903 | Bray | 72/201 |
| 1,982,571 | 11/1934 | Clark | 72/201 |
| 1,994,691 | 3/1935 | Dahl et al. | 72/236 |
| 2,033,046 | 3/1936 | Montgomery | 72/201 |
| 2,107,541 | 2/1938 | Long | 72/201 |
| 3,605,473 | 9/1971 | Lyon et al. | 72/201 |
| 3,613,425 | 10/1971 | Roberts | 72/202 |

FOREIGN PATENT DOCUMENTS

| | | | |
|---|---|---|---|
| 1,924,319 | 11/1970 | Germany | 72/201 |
| 46-27289 | 8/1971 | Japan | 72/201 |
| 37-69 | 1/1962 | Japan | 72/201 |

*Primary Examiner*—E. M. Combs

*Attorney, Agent, or Firm*—Cooper, Dunham, Clark, Griffin & Moran

[57] ABSTRACT

In a rolling mill for reducing metal, having upper and lower work rolls between which the metal is passed and at least one back-up roll for the upper work roll, the combination of means for applying coolant to the surface of the upper work roll only on the outgoing side of the mill, casing structure enclosing the locality of coolant application and so arranged that a narrow gap is defined between the upper work roll and a transverse wall of the casing below the coolant-applying means, and means for creating a rapid flow of air along the upper work roll surface adjacent the gap in a direction to prevent exit of coolant through the gap from the casing structure while withdrawing air from the casing structure. The air-flow creating means may include means for maintaining the interior of the casing structure at subatmospheric pressure. A method of cooling the upper work roll in such a mill comprises applying coolant to the surface thereof only at a locality on the outgoing side of the mill while maintaining an enclosure in surrounding relation to the coolant-applying locality with a narrow gap defined between the enclosure and the upper work roll surface at a level below that locality, and directing a rapid flow of air along the latter roll surface adjacent the gap to prevent exit of coolant through the gap. The back-up roll, which is in contact with the upper work roll, cooperates with the foregoing structures and steps to prevent carryover of excessive coolant onto the upper work roll surface on the ingoing side of the mill.

7 Claims, 3 Drawing Figures

APPARATUS FOR COOLING THE ROLLS OF ROLLING MILLS

This is a division of application Ser. No. 585,460 filed June 10, 1975, U.S. Pat. No. 3,994,151.

BACKGROUND OF THE INVENTION

The present invention relates to rolling mills and in particular relates to a method for cooling the mill rolls and apparatus for performing such method.

As is well known, much heat is transferred to the work rolls of a rolling mill at the points of contact between the work rolls and the strip or ingot. In addition to the heat energy generated in reducing metal thickness, in hot-rolling mills heat is transferred to the rolls from the preheated ingot. It is well known that the heat introduced into the work rolls must be dissipated in order to prevent excessive temperature rise, which can destroy the surface finish of the rolls. It is also necessary to control the temperature of the work rolls to ensure that they do not deviate excessively from the predetermined camber.

It has been the common practice heretofore to lubricate and cool the rolls of a rolling mill by flooding the work rolls and strip at the entry side of the mill with a coolant/lubricant liquid consisting of a cooling medium in which one or more lubricants are present. Because of their much higher cooling capacity, it is the practice to employ aqueous emulsions as coolant/lubricants in hot rolling and it would be advantageous to use water-based lubricants in cold rolling of aluminum. The objection to such a water-base coolant/lubricant system, particularly in cold-rolling, is the presence of this coolant/lubricant on the outgoing strip, since either the lubricant components, or the water base, or both, tend to stain aluminum. This tendency to stain is, of course, dependent on the amount of coolant/lubricant remaining on the strip after passage through the mill, the small amount carried through the roll bite in the particular region where the work roll is in contact with the strip being insufficient to cause subsequent staining problems. However, in the usual "flood lubrication" practice significant amounts of the coolant/lubricant come through the roll bite, around the edges of the strip; in consequence, some coolant/lubricant often splashes onto the surfaces of the outgoing strip. The occurrence of coolant/lubricant on the outgoing strip in local or general deposits of appreciable thickness is objectionable from its tendency to subsequently stain the aluminum.

SUMMARY OF THE INVENTON

The principal object of the present invention is to provide a system for cooling the rolls, and especially the work rolls, of a rolling mill for reducing metal, especially aluminum, which may be arranged so that excess coolant/lubricant is kept out of contact with the metal strip on the outgoing side of the mill. Since very large quantities of coolant are used to ensure adequate cooling of the rolls in rolling mills of high capacity, it is necessary to provide a containment system which is effective to ensure that not more than a small amount of coolant/lubricant is carried through the mill bite and thus avoids the applied coolant/lubricant from coming into contact with the outgoing strip in localized or general excess. In order to achieve this object, the coolant is applied to the surface of the rolls on the outgoing side of the roll bite. Thus at most, only a small amount of coolant/lubricant will be carried through the line of contact between the backing roll and the work roll, so that only a thin film of, if any, coolant is carried on the ingoing surface of the work roll into the roll bite so as to remain as a film on the outgoing strip.

The lubrication of the rolling operation, as opposed to the cooling of the mill rolls, may be effected by the application of a thin film of lubricant to the work rolls on the ingoing side of the mill or reliance may be placed on carrying sufficient lubricant through between the line of contact between the work roll and the back-up roll where the lubricant is an oil-phase dispersed in aqueous medium, which forms the coolant.

While the application of coolant to the outgoing surface of the mill rolls will ensure, subject to precautions to prevent splashing, that the amount of coolant present on the work rolls at the roll bite is held at a suitably low level, it in no way prevents the splashing of the coolant-/lubricant directly from the surface of the rolls onto the surface of the outgoing strip, either by direct splashing or, in the case of the upper work roll, by running down the rising, outgoing surface of the upper work roll.

In the operation of the present invention, at least the upper work roll of a rolling mill is provided with means for applying coolant to its surface on the outgoing side of the mill at a location enclosed within a casing which has a pair of transversely extending walls, the edge of one wall being located at a first position in close proximity to the periphery of the work roll and the edge of the other wall being located at a second position in close proximity to the periphery of the work roll or to the periphery of a roll in contact with said work roll, means being provided for preventing a substantial flow of coolant out of the casing toward the roll bite on the outgoing side of the mill. This is most conveniently achieved by establishing a rapidly moving stream of air into the casing through the narrow gap between the edge of the transversely extending casing wall and the adjacent roll periphery which has the effect of wiping off any flowing stream of coolant on the work roll surface. It also has the effect of preventing the escape of droplets of the coolant by the same route. Most preferably the coolant is applied to the surface of the rolls by means of spray jets so as to ensure turbulence and contact of the roll surface by fresh cool liquid. Most conveniently, therefore, the casing is maintained at subatmospheric pressure to withdraw liquid droplets splashed from the roll surfaces and simultaneously to establish a rapidly moving stream of air into the casing. For this reason the whole periphery of the casing in such arrangement must be in close proximity (including possible rubbing contact) with the surface of the adjacent roll or rolls.

In one arrangement in accordance with the invention the coolant is applied to at least the upper work roll and possibly also to the associated backing roll at a location within a containment casing positioned on the outgoing side of the mill with the edges of the transverse walls respectively being in close proximity to the periphery of the work roll and to the periphery of the associated backing roll. In an alternative arrangement, the work roll and its associated backing roll or rolls are essentially wholly enclosed in a containment casing, the edges of the transverse walls being in close proximity to the periphery of the work roll near to the roll bite on the ingoing side and outgoing side respectively. In these arrangements, the outflow of coolant between the transverse wall of the casing cooperating with the work roll on the outgoing side of the mill is restrained by the inward flow of air. The same means may be employed around the remainder of the periphery of the casing, or alternatively a rubbing seal may be employed around at least part of such periphery.

The air stream prevents the escape of a flowing stream of coolant on the work roll surface. However, the above-quoted alternative arrangement does not prevent the necessary film of lubricant from being drawn into the roll bite. While less essential, a similar arrangement is preferably employed in conjunction with the application of coolant/lubricant to the lower work roll also. By retaining the coolant/lubricant within the containment casing by means of a stream of air between the transverse wall of the casing and the periphery of the work roll, the possibility of damage to the work roll, which may exist if there is contact between the work roll and a seal member, is obviated. The end walls of the casing, which lie outwardly beyond the limits of the operative portions of the roll surface, may be provided with rubbing seals to prevent the outward spread of coolant/lubricant. However, at these positions also, it is preferred to prevent the outward movement of the coolant/lubricant by means of an inward air stream. The air streams at the periphery of the casing may be established by means of high pressure air jets emitted from nozzles or elongated slit orifices arranged along the edges of the walls of the casing and directed on to the adjacent surface of the roll in a direction inwardly of the casing. There is at the same time the necessity to provide an exhaust from the casing to allow the escape of the inflowing air. In most cases, it is possible to establish a sufficiently rapidly moving stream of air to contain the coolant/lubricant by establishing subatmospheric pressure within the casing by means of a high capacity air pump, and this is the preferred method of establishing the desired stream of air. The end walls of the casing are also preferably shaped so as to establish a slit-like aperture between themselves and the adjacent peripheries of the rolls. Any tendency for the coolant-/lubricant to leak past the end seals, at the work roll-/back-up roll interface, as a result of a build-up of coolant/lubricant in that location, may be prevented by directing an air jet inwardly at this point or by using a jet of coolant/lubricant directed inwardly from the ends of the casing to prevent the outward flow of coolant/lubricant. Thus in a containment system for the coolant/lubricant applied to the upper rolls (work roll and backing roll) of a rolling mill, the edges of the upper and lower transverse walls of the containment casing are preferably respectively located above and below the level of the axes of the backing roll and work roll respectively, to leave a large area of roll surface exposed within the casing, to permit effective cooling by the coolant/lubricant which is applied to the rolls preferably by spray jets located within the casing. A drain is provided, preferably in the lower part of the containment casing, to drain the coolant/lubricant and an exhaust, preferably connected to an exhausting pump, is provided in the upper part of the casing. Means may be provided for collecting spray droplets carried out of the casing in the exhaust air stream.

Further features and advantages of the invention will be apparent from the detailed description hereinbelow ser forth, together with the accompanying drawing.

DETAILED DESCRIPTION

Figure 1:
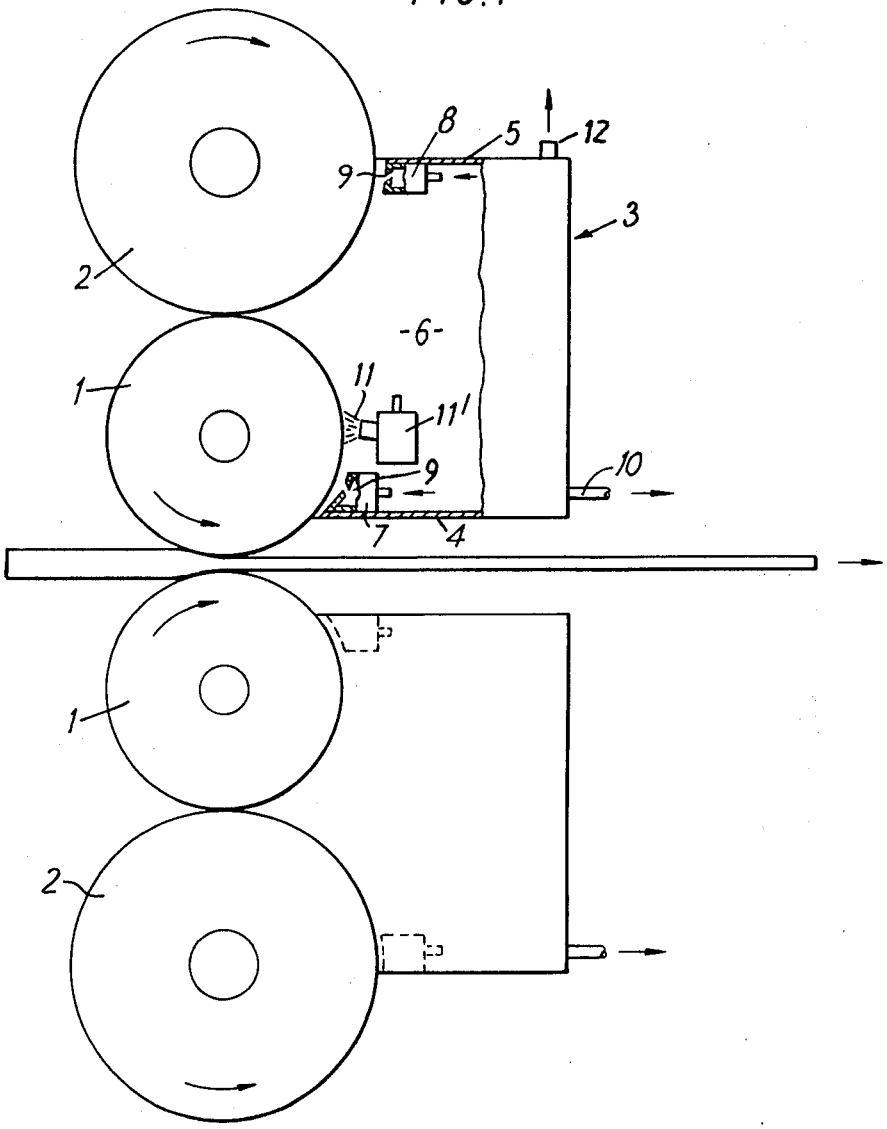
FIG. 1 is a semidiagrammatic side view of one form of coolant/lubricant system associated with a rolling mill.

In FIG. 1, the work rolls 1 and backing rolls 2 are associated with a coolant containment casing 3, which extends for substantially the full width of the rolls and is provided with lower and upper transverse wall members 4 and 5 and end plates 6. The end plates 6 carry edge seal members which are in rubbing contact with the rolls 1 and 2, whereas the edges of the transverse wall members 4 and 5 are spaced from the rolls 1 and 2 by a distance of, for example, 5 mm. Air pressure manifolds 7 and 8 extend along the forward edges of the transverse members 4 and 5 and each is provided with a continuous inclined slit 9 to direct a stream of air obliquely onto the adjacent surface of the rolls 1 and 2 to contain the liquid in the casing 3, from which it is carried away by means of a drain outlet 10. The coolant is applied to the work roll 1 by means of sprays 11 to which the coolant is supplied under pressure from a manifold 11', for example in an amount of up to about 1–2 liters/min/cm of roll length. In the construction of FIG. 1, the air in the casing is slightly above atmospheric pressure, and an air outlet 12 may be provided at any convenient location. Alternatively, an air pump (not shown in FIG. 1) may be provided to exhaust air via the outlet 12 to maintain subatmospheric conditions within the casing. The lower work roll 1 and back-up roll 2 are preferably provided with a similar system, as shown, for the containment of coolant/lubricant.

It is desirable to keep as small as possible the depth of accumulated coolant/lubricant adjacent to the lower roll in a casing, to minimize interference with the cooling action of the coolant/lubricant being applied directly onto the rolls by the spray jets. When large flowrates of coolant/lubricant are employed, it is convenient to accomplish this by an alternative construction illustrated in FIG. 2, in which a two-chamber system is provided. In this construction, the containment casing comprises a bottom member 14 and a top member 15, which terminate, as before, at a distance of approximately 5 mms from the periphery of the rolls 1 and 2. In this construction, the edges of the end plates 16 are similarly spaced from the rolls 1 and 2. The interior of the casing is divided into a forward or outer chamber 17 and a rear or inner chamber 18 by means of a partition 19, the lower edge of which is positioned close to the lower transverse member 14. The forward member 17 is exhausted by a pump 20 and the rear chamber 18 by a pump 21. Coolant/lubricant is applied to the surface of the rolls 1 and 2 by means of spray jets 22 which are positioned at intervals across the full width of the casing. Air is evacuated by means of pump 20 from the forward compartment 17 and a subatmospheric pressure is maintained therein which leads to the entrance of a rapid stream of air between the edges of the members 14, 15 and 16 and the adjacent roll surfaces in a direction substantially tangential to the rolls so as to contain the coolant/lubricant. The pump 21 is operated so as to maintain an even lower pressure in the rear compartment 18. The pressure difference thus established serves to draw the coolant/lubricant from the forward compartment under the partition 19 into the rear compartment, thus maintaining a desirably low liquid level in the forward compartment while allowing a high enough level in the rear compartment to facilitate drainage large volumes of liquid via a drain 23. The lower work roll 1 and back-up roll 2 are preferably provided with a similar system for the containment of the coolant/lubricant, but the air outlets are differently arranged, as indicated.

Figure 2:
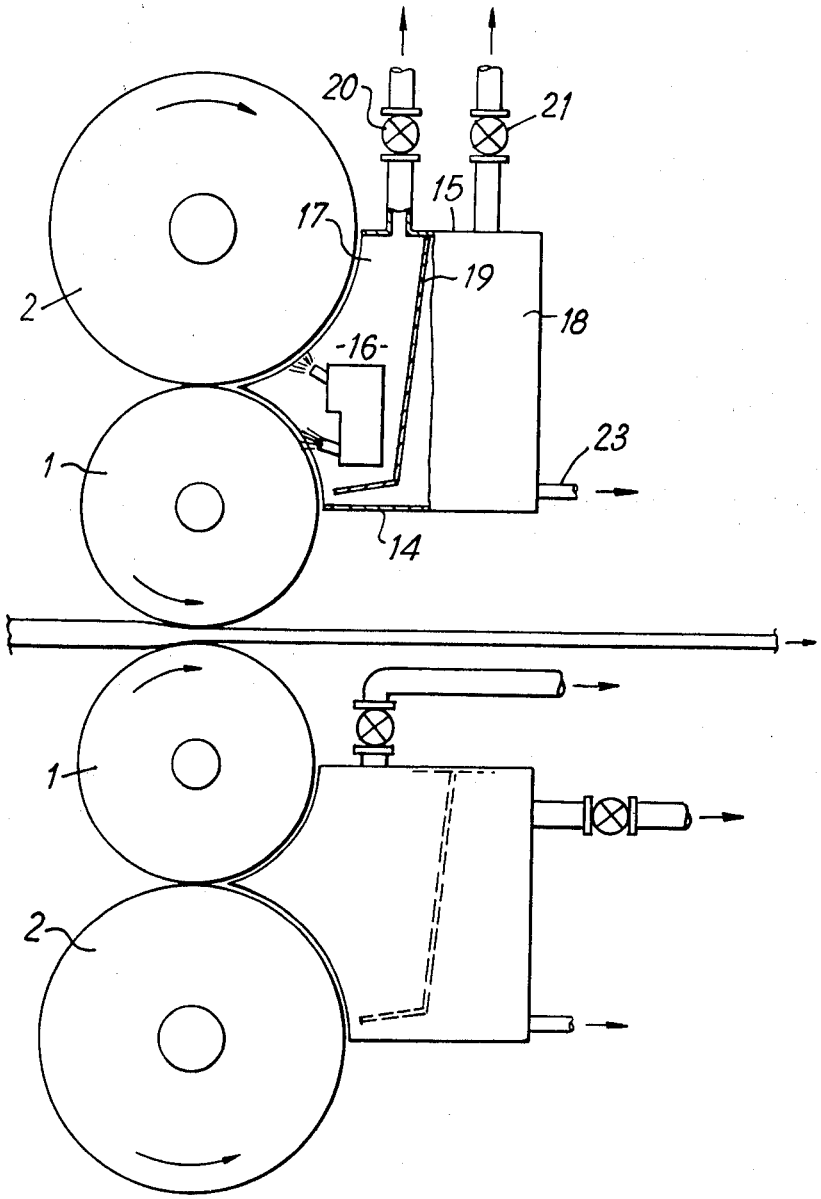
FIG. 2 is a side view of a somewhat modified form of coolant/lubricant system.

It is desirable that a range of roll diameters be accommodated by the end plates 6 of FIG. 1, and 16 of FIG. 2, to allow for diameter change arising when the rolls are reground. This can be accomplished by providing means (not shown) for adjusting the edge profile of the members 16, or by making it self-adjusting, for example by spring-loaded rubbing seals (not shown).

In both the constructions of FIGS. 1 and 2, the coolant containment casing is wholly on the outgoing side of the roll bite, this being effective from the point of view that the movement of the roll surface is in a direction which assists the air streams in containing coolant/lubricant within the casing and that there is opportunity provided for increased area of exposure of the roll surface to the coolant. To assist the air streams in containing the coolant/lubricant within the casing, it is desirable to have those spray jets which are closest to the roll casing openings directed onto the roll at an off-normal angle so that no significant component of the spray is directed into the gap in opposition to the incoming air stream.

Figure 3:
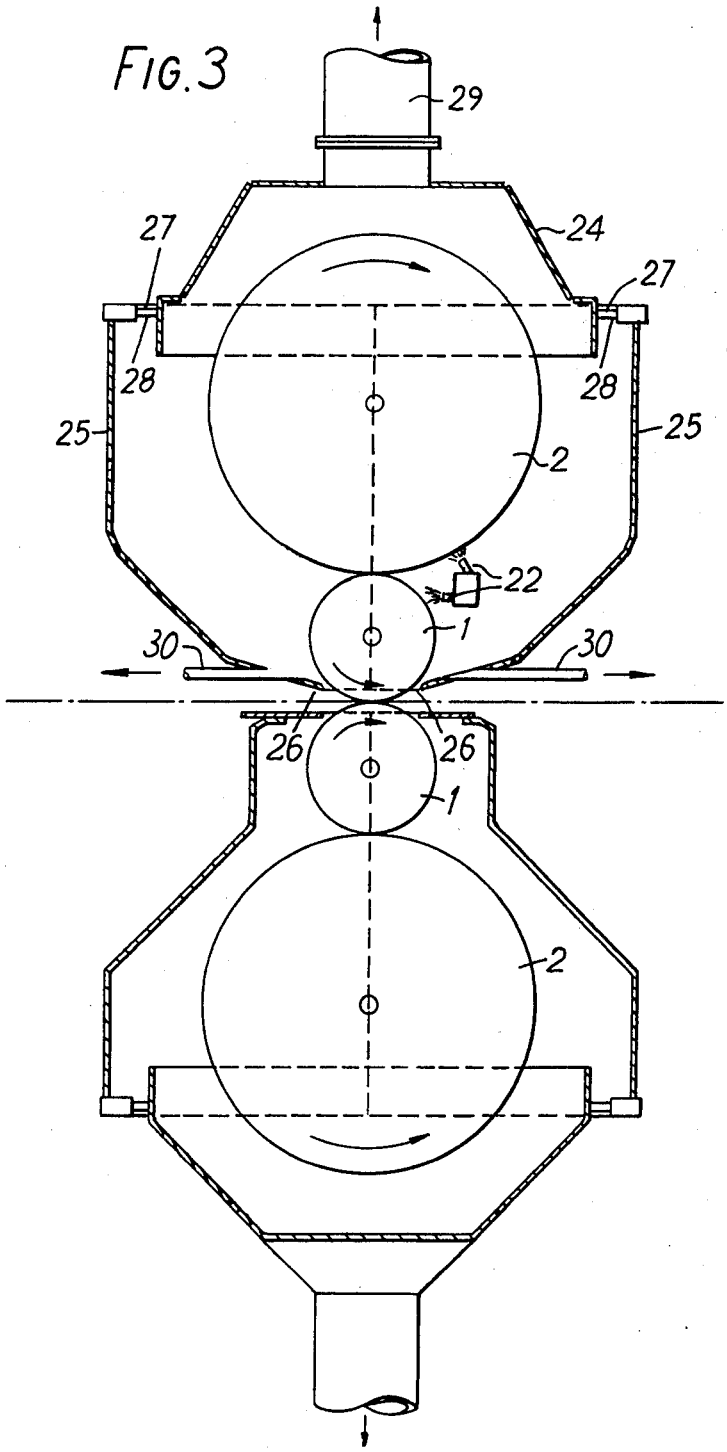
FIG. 3 is a side view of another form of coolant/lubricant system.

Another way of achieving containment is a construction as shown in FIG. 3 in which a hood 24 is fixed on to the back-up roll chocks so as to move vertically with the roll 2 during any adjustment. A two-part enclosure 25 is mounted on the mill housing and the parts are movable horizontally towards and away from each other and vertically to adjust the gap between the enclosure and the work roll 1 and to clear away the spray assembly 22, which is supported by the enclosure, to assist in roll changing. In the case of the upper work roll/back-up roll system, gaps 26 are provided between the transverse walls of the enclosure 25 and the work roll 1, on both the ingoing and the outgoing side of the roll bite. At the upper end of the enclosure 25 are seals 27 which cooperate with the transverse and end surfaces 28 of the hood in such a way that free movement of the hood is permitted when it moves during the roll-gap adjusting action and yet will also hold a subatmospheric pressure in the space confined by the hood/enclosure structure which together act as a containment casing. Although in FIG. 3 the seals 27 are indicated as being oriented laterally across the mill, there is also provided a similar moving seal arrangement between the ends of the enclosure and the hood. The chamber formed by the hood/enclosure system is exhausted by a pump 29 to maintain a small subatmospheric pressure therein which results in the same rapid ingress of air through the gaps 26 as in the construction of FIG. 2, so as to contain the coolant/lubricant. Drains 30 are provided to lead off the coolant/lubricant at both ingoing and outgoing sides of the roll bite. A secondary inner chamber system may be used which is constructed and functions in a manner similar to that described for FIG. 2. In such case a secondary exhaust pump is provided to maintain a lower pressure in the secondary inner chamber, out of which the contained liquid is drained.

The lower work roll 1 and back-up roll 2 are preferably provided with a similar system for the containment of the coolant/lubricant. In both systems the hood exhaust connection is arranged for easy disassembly so that the stationary piping of the exhaust systems are separated from the hoods during the back-up roll changes.

In the constructions of FIGS. 1, 2 and 3, the coolant applied to the rolls may be water, in which case a separate means (not shown) is provided for applying a thin film of rolling lubricant to the work rolls on the ingoing side of the roll bite, usually in an amount less than 1% of the coolant. Alternatively, the coolant/lubricant applied to the rolls within the coolant container casing may be a water-base coolant/lubricant which is carried through between the work roll 1 and back-up roll 2 so as to provide a lubricant on the surface of the work roll. As previously explained, the amount carried through on the surface of the work roll is not sufficient to cause subsequent staining of the strip.

It will be appreciated that the constructions of FIGS. 1, 2 and 3 may be subject to a number of variations. Thus, the effect of the pump 20 in FIG. 2 may be supplemented by the use of pressure air jets of the type indicated in FIG. 1 to increase the air containment action. In FIG. 2, the pump 21 may be connected to the drain 23 to maintain the decreased pressure conditions in the rear compartment 18, to withdraw both liquid and air from the rear compartment, these two components being subsequently separated from one another.

It is emphasized that the advantage of the coolant/lubricant system of the present invention is that little, if any, of the roll coolant/lubricant is carried forward on the surface of the strip on the outgoing side of the mill. In addition to prevention of staining of the strip, there are also other advantages to preventing excess coolant/lubricant from getting on to the strip. For example, in rolling aluminum, the surface quality will be improved through excess coolant/lubricant not being carried through the roll bite, resulting in reduced pitted surface of the strip. With the coolant/lubricant system of the present invention, it is also possible to control the temperature of the rolls and of the strip independently, which is of special advantage in hot rolling where it may be desirable to avoid unnecessary cooling of the slab or strip.

It is to be understood that the inventon is not limited to the features and embodiments hereinabove specifically set forth but may be carried out in other ways without departure from its spirit.

We claim:

1. A rolling mill for metal reduction comprising a. upper and lower work rolls defining a roll bite through which the metal is passed, for reduction, from an ingoing side to an outgoing side of the mill, b. at least one back-up roll in contact with said upper work roll along a line of contact, c. means for applying liquid coolant to the outer surface of said upper work roll at a locality on only the outgoing side of the mill above said roll bite, d. a containment casing providing an enclosure in surrounding relation to said locality of application of liquid coolant for confining, in cooperation with said upper work roll and said one back-up roll, a region which includes said locality and extends from a first level intermediate said locality and said roll bite to a second level above said line of contact, said casing including a first transversely arranged wall lying in close proximity to, but spaced from, the surface of the upper work roll to define therewith a first narrow gap at said first level between said upper work roll and said enclosure for preventing contact between said upper work roll and said enclosure at least along a working portion of said upper work roll surface as said upper work roll rotates, the direction of movement of said work roll outer surface past said first gap being into said enclosure, e. said casing further including a second transversely arranged wall lying in close proximity to, but spaced from, the surface of said one back-up roll for defining a second narrow gap between said one back-up roll and said enclosure, the direction of movement of the outer surface of said back-up roll past said second gap being into said enclosure, f. means for establishing a rapidly moving flow of air along the surface of said upper work roll adjacent said first gap in a direction for preventing downflow of coolant through said first gap while causing exit of air from said casing, thereby to seal at least said first gap against exit of coolant therethrough from said confined region, and g. means for withdrawing coolant from within said casing.

2. A rolling mill according to claim 1, including means for establishing subatmospheric conditions within said casing whereby to establish rapidly moving streams of air between said first and second transversely arranged walls and the adjacent roll surfaces.

3. A rolling mill according to claim 2 further including a transverse partition within said casing extending downwardly from the top of the casing to define a gap between said partition and the floor of said casing whereby to constitute an inner chamber and an outer chamber lying between said partition and the surface of said work roll, means for establishing subatmospheric pressure in said outer chamber, means for establishing a lower pressure in said inner chamber, the means for draining off the coolant from said casing lying within said inner chamber.

4. A mill according to claim 1, further including means for applying liquid coolant to the outer surface of said back-up roll on only the outgoing side of the mill at a locality intermediate said line of contact and said second gap.

5. A mill according to claim 1, and wherein said air-flow establishing means further comprises means for producing a continuous rapidly moving flow of air along said back-up roll surface in a direction for preventing exit of coolant from said confined region through said second gap.

6. A mill according to claim 5, wherein said air-flow-establishing means comprises means for maintaining the air pressure in said confined region at a value lower than ambient atmospheric pressure.

7. A mill according to claim 1, further including a. a lower back-up roll for said lower work roll;

b. means for applying coolant to the outer surface of said lower work roll at a locality on only the outgoing side of said mill:

c. second casing structure cooperating with said lower back-up roll and said lower work roll for confining a region surrounding said last-mentioned locality, said second casing structure including a transverse wall portion extending into close proximity to said lower work roll surface at a level intermediate said first roll bite and said last-mentioned locality but spaced from said lower work roll surface to define therewith a narrow gap; and d. means for producing a continuous rapidly moving flow of air along said lower work roll surface adjacent said last-mentioned gap in a direction for preventing exit of coolant through said gap from said last-mentioned confined region.

* * * * *